US011340044B1

(12) United States Patent
Fuerte

(10) Patent No.: US 11,340,044 B1
(45) Date of Patent: May 24, 2022

(54) RIOT SHIELD ASSEMBLY

(71) Applicant: Valentin Fuerte, San Jose, CA (US)

(72) Inventor: Valentin Fuerte, San Jose, CA (US)

( * ) Notice: Subject to any disclaimer, the term of this patent is extended or adjusted under 35 U.S.C. 154(b) by 0 days.

(21) Appl. No.: 17/344,772

(22) Filed: Jun. 10, 2021

(51) Int. Cl.
*F41H 5/08* (2006.01)
*A62C 25/00* (2006.01)
*F41H 9/10* (2006.01)

(52) U.S. Cl.
CPC ..... *F41H 5/08* (2013.01); *A62C 25/00* (2013.01); *F41H 9/10* (2013.01)

(58) Field of Classification Search
CPC ..... F41H 5/08; F41H 9/10; A62C 25/00
See application file for complete search history.

(56) References Cited

U.S. PATENT DOCUMENTS 3,844,449 A * 10/1974 Alter ..... F41H 9/10 222/399
4,254,833 A * 3/1981 Perry ..... A62C 15/00 169/88
4,830,245 A * 5/1989 Arakaki ..... F41H 5/08 2/2.5
7,302,880 B1 * 12/2007 Elasic ..... F41H 13/0087 89/36.01
D613,457 S 4/2010 Miller
8,276,680 B2 * 10/2012 Bouthiette ..... A62C 13/66 169/44
2007/0125224 A1 * 6/2007 Thomas ..... F41H 5/08 89/36.07
2008/0087684 A1 4/2008 Koshimoto
2010/0090026 A1 * 4/2010 Pearson ..... F41H 9/10 239/304
2011/0226123 A1 * 9/2011 Priebe ..... F41H 5/08 89/36.02
2014/0076996 A1 * 3/2014 Hayton ..... A62C 25/00 239/289
2019/0174903 A1 * 6/2019 Holder ..... A45F 3/06
2022/0055049 A1 * 2/2022 Rankin, Sr. ..... B05B 9/0833

FOREIGN PATENT DOCUMENTS

WO WO2007126395 11/2007

* cited by examiner

*Primary Examiner* — Joshua E Freeman

(57) ABSTRACT

A riot shield assembly for deploying pepper spray or a fire retardant from a riot shield includes a backpack that is wearable on a police officer's back. A riot shield is carried by the police officer to protect the police officer from rioters. A pepper spray unit is positioned in the backpack and the pepper spray unit is in communication with the riot shield. The pepper spray unit sprays a pepper spray outwardly from the riot shield to deter rioters. A fire retardant unit is positioned in the backpack and the fire retardant unit is in communication with the riot shield. The fire retardant unit sprays a fire retardant outwardly from the riot shield to extinguish a fire.

11 Claims, 6 Drawing Sheets

RIOT SHIELD ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to riot shield devices and more particularly pertains to a new riot shield device for deploying a pepper spray or a fire retardant from a riot shield. The device includes a backpack which contains a pair of canisters, a riot shield and a pair of hoses which extend between the canisters and the riot shield. A pair of nozzles is integrated into the riot shield and the hoses spray a pepper spray or a fire retardant outwardly from the riot shield.

(2) Description of Related Art Including Information Disclosed Under 37 CFR 1.97 and 1.98

The prior art relates to riot shield devices including a portable fire extinguisher that is integrated into a backpack. The prior art discloses a ballistic shield designed to be carried with a single arm. The prior art discloses a police shield with a sprayer integrated into the police shield for spraying a substance. In no instance does the prior art disclose a riot shield and a backpack which contains a pepper spraying unit and a fire retardant unit, each being in fluid communication with the riot shield.

BRIEF SUMMARY OF THE INVENTION

An embodiment of the disclosure meets the needs presented above by generally comprising a backpack that is wearable on a police officer's back. A riot shield is carried by the police officer to protect the police officer from rioters. A pepper spray unit is positioned in the backpack and the pepper spray unit is in communication with the riot shield. The pepper spray unit sprays a pepper spray outwardly from the riot shield to deter rioters. A fire retardant unit is positioned in the backpack and the fire retardant unit is in communication with the riot shield. The fire retardant unit sprays a fire retardant outwardly from the riot shield to extinguish a fire.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
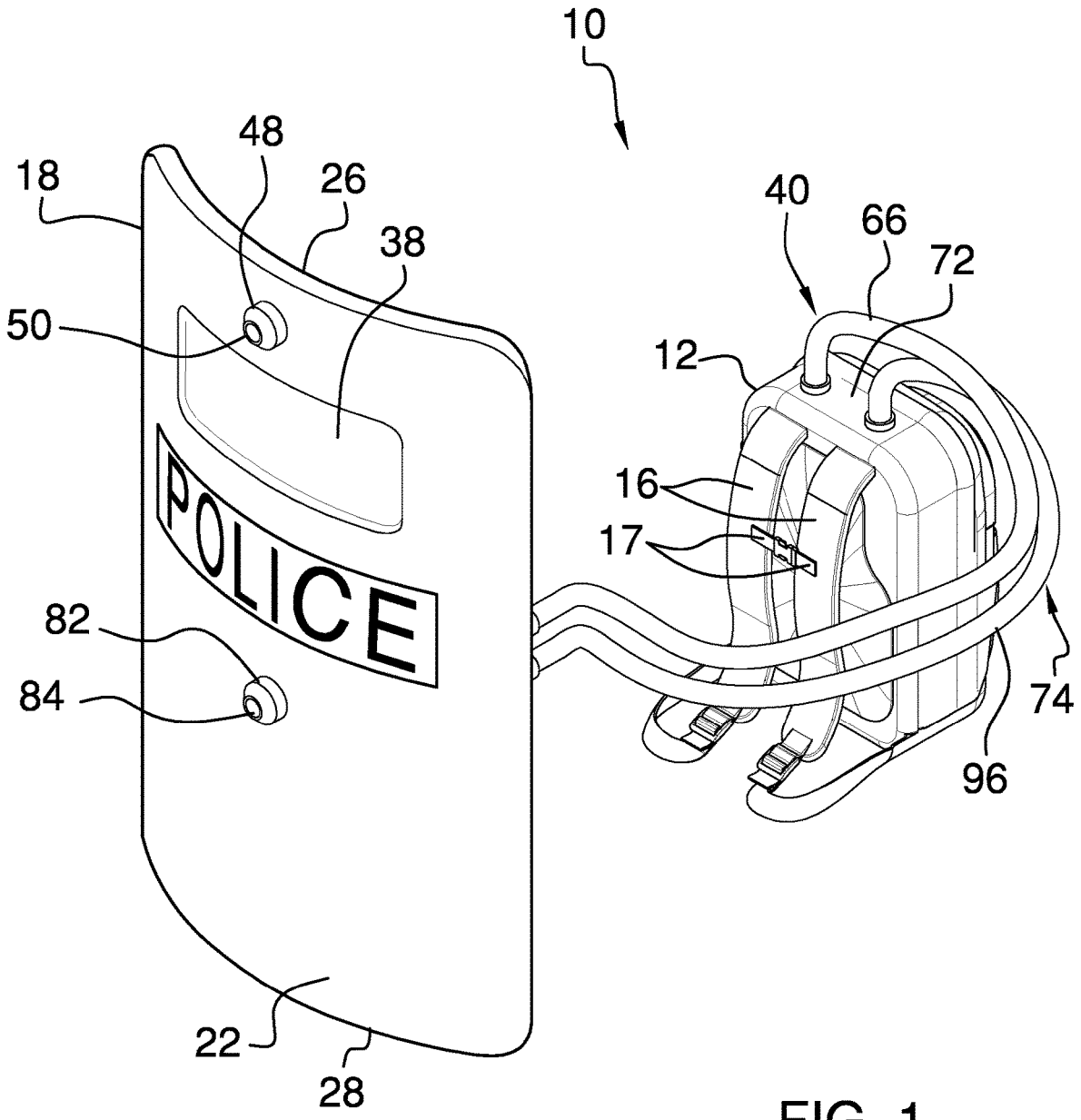
FIG. 1 is a perspective view of a riot shield assembly according to an embodiment of the disclosure.
Figure 2:
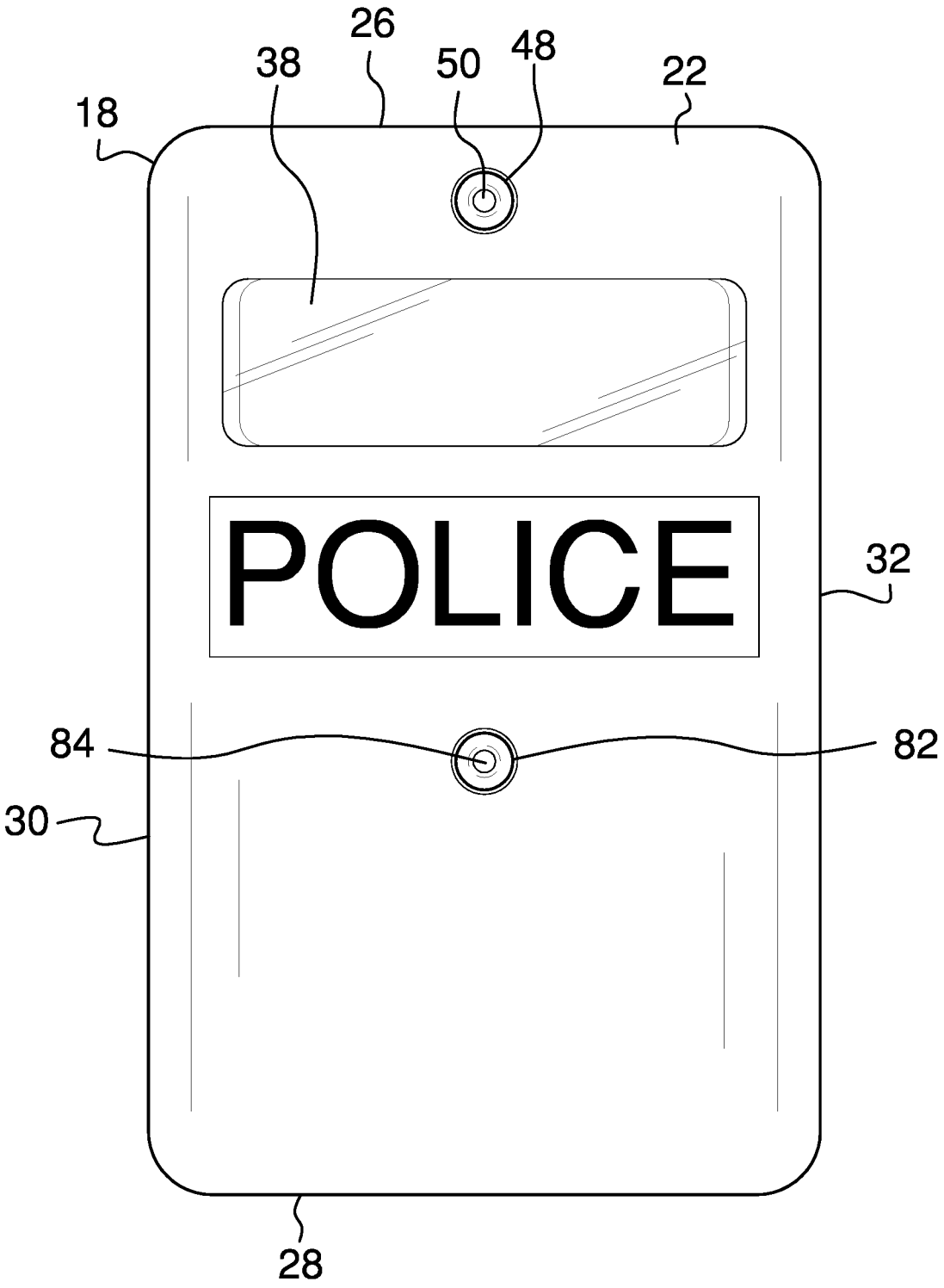
FIG. 2 is a front view of a riot shield of an embodiment of the disclosure.
Figure 3:
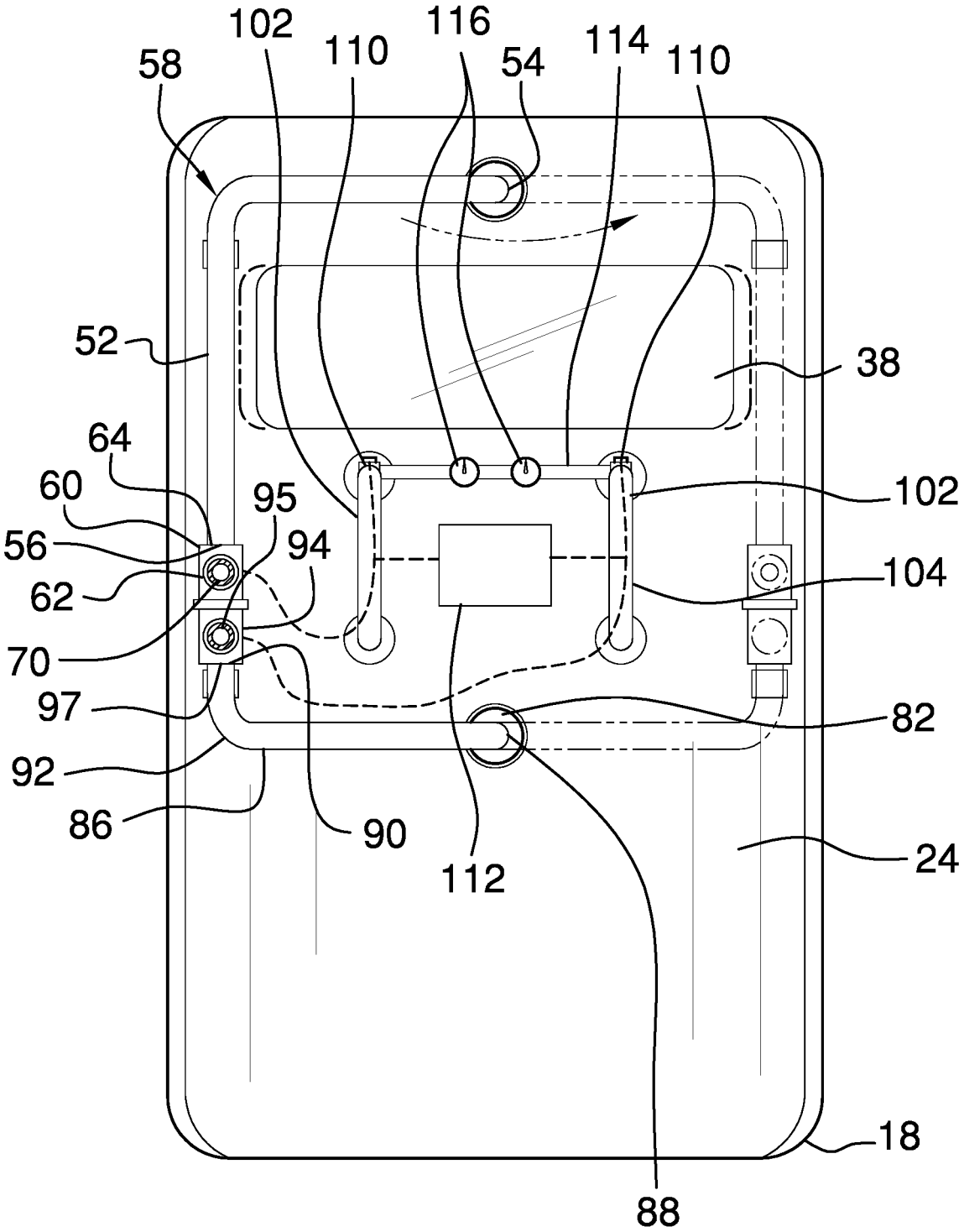
FIG. 3 is a back view of a riot shield of an embodiment of the disclosure.
Figure 4:
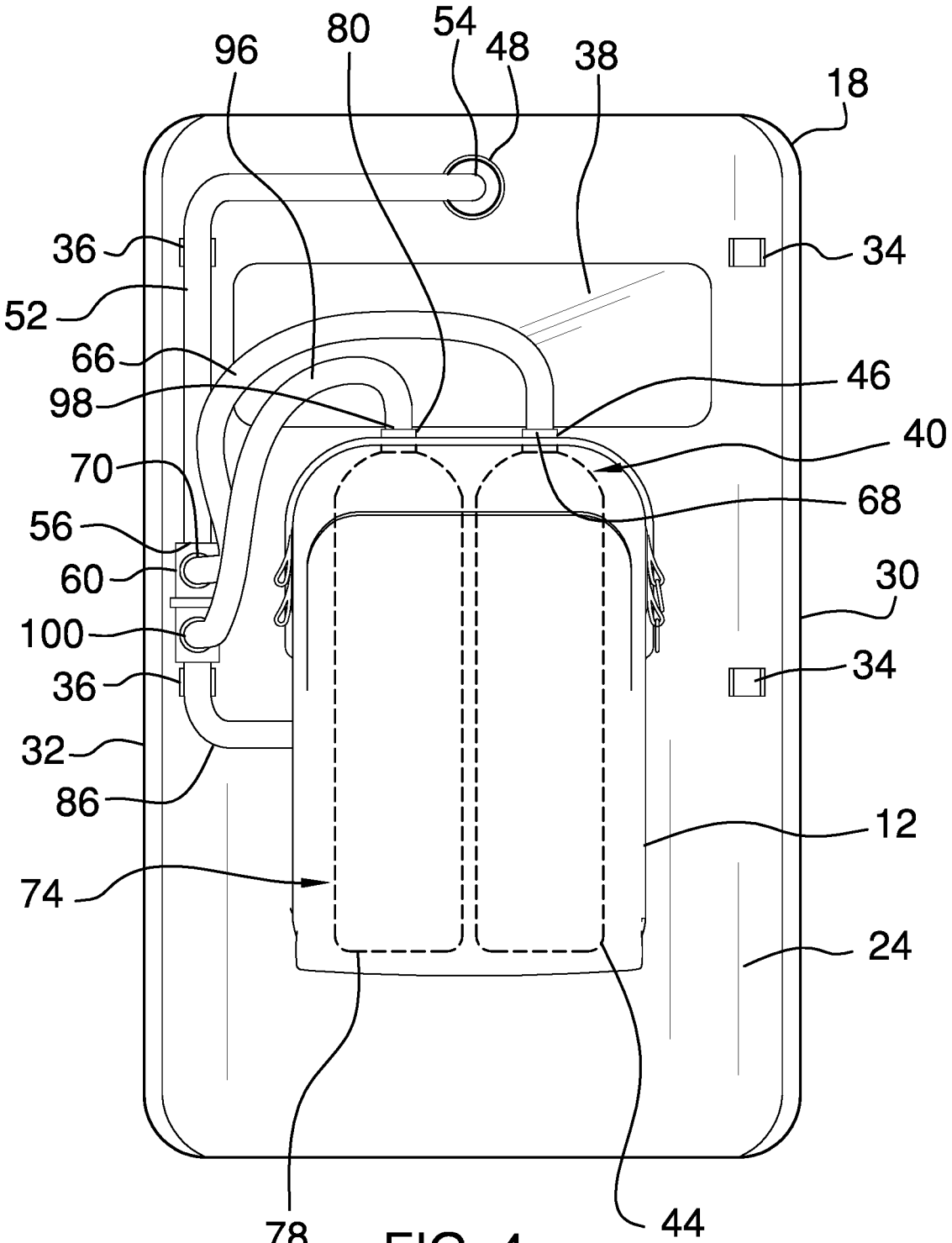
FIG. 4 is a back phantom view of an embodiment of the disclosure.
Figure 5:
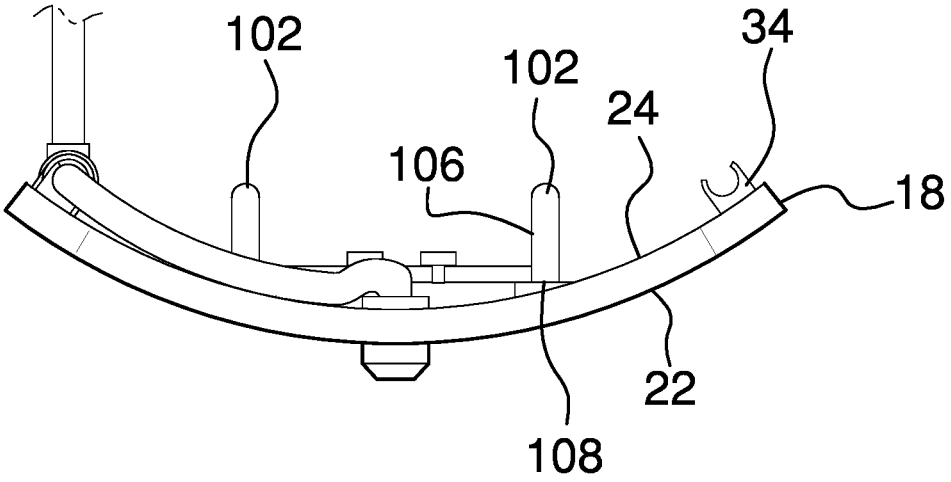
FIG. 5 is a top view of a riot shield of an embodiment of the disclosure.
Figure 6:
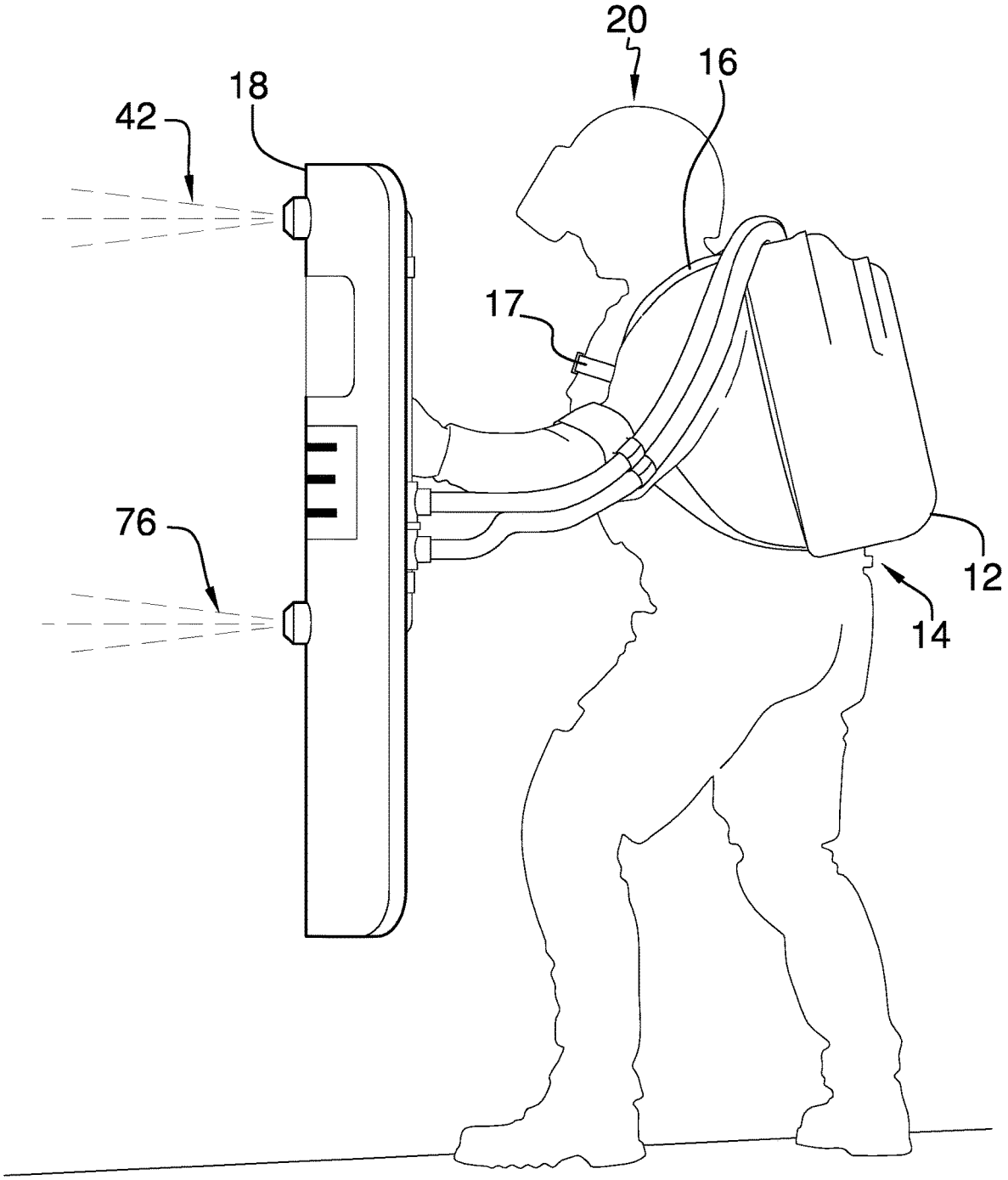
FIG. 6 is a perspective in-use view of an embodiment of the disclosure.

With reference now to the drawings, and in particular to FIGS. 1 through 6 thereof, a new riot shield device embodying the principles and concepts of an embodiment of the disclosure and generally designated by the reference numeral 10 will be described.

As best illustrated in FIGS. 1 through 6, the Riot shield assembly 10 generally comprises a backpack 12 that is wearable on a police officer's back 14, and the backpack 12 includes a pair of shoulder straps 16. A pair of chest straps 17 is each coupled to a respective one of the shoulder straps 16 and each of the chest straps 17 is matable together for enhancing stability of the backpack 12 when the police officer 14 is in motion. Additionally, the chest straps 17 can be uncoupled to facilitate the backpack 12 to be easily removed. A riot shield 18 is provided that can be carried by the police officer 20 to protect the police officer 20 from rioters. The riot shield 18 has a front side 22 and a back side 24, and the riot shield 18 is elongated between a top edge 26 and a bottom edge 28 of the riot shield 18. Additionally, the riot shield 18 may be concavely arcuate between a first lateral edge 30 and a second lateral edge 32 of the riot shield 18. The riot shield 18 has a set of first clips 34 each being coupled to the back side 24. Each of the first clips 34 is positioned adjacent to the first lateral edge 30 of the riot shield 18. The riot shield 18 has a set of second clips 36 each being coupled to the back side 24 and each of the second clips 36 is positioned adjacent to the second lateral edge 32 of the riot shield 18. The riot shield 18 has a window 38 that is integrated into the riot shield 18 to facilitate the police officer 20 to see through the riot shield 18, and the window 38 is positioned adjacent to the top edge 26.

A pepper spray unit 40 is positioned in the backpack 12 and the pepper spray unit 40 is in communication with the riot shield 18. Moreover, the pepper spray unit 40 sprays a pepper spray 42 outwardly from the riot shield 18 when the pepper spray unit 40 is turned on to deter rioters. The pepper spray unit 40 comprises a first canister 44 that contains a pepper spray 42. The first canister 44 is positioned in the backpack 12 and the first canister 44 has an outlet 46. Additionally, the pepper spray 42 may comprise any pressurized, chemical irritant that is commonly employed by law enforcement. The pepper spray unit 40 includes a first nozzle 48 which extends through the front side 22 and the back side 24 of the riot shield 18. The first nozzle 48 has a distal end 50 with respect to the front side 22, the distal end 50 is open and the first nozzle 48 is positioned between the window 38 and the top edge 26 of the riot shield 18.

The pepper spray unit 40 includes a first conduit 52 that has a primary end 54 and a secondary end 56, and the first conduit 52 has a bend 58 positioned between the primary end 54 and the secondary end 56. The primary end 54 is fluidly coupled to a back side 24 of the first nozzle 48 and the primary end 54 is pivotable on the back side 24. Thus, the first conduit 52 can be pivoted on the first nozzle 48 to be positioned in either the set of first clips 34 or the set of second clips 36. In this way the first conduit 52 can accommodate a left handed police officer 20 or a right handed police officer 20.

The pepper spray unit 40 includes a first pump 60 that is coupled to the back side 24 of the riot shield 18, and the first pump 60 has an inlet 62 and an outlet 64. The outlet 64 of the first pump 60 is fluidly coupled to the secondary end 56 of the first conduit 52. The first pump 60 may comprise an electric fluid pump or the like. The pepper spray unit 40 includes a first hose 66 that has a first end 68 and a second end 70. The first end 68 is fluidly coupled to the outlet 46 on the first canister 44 having the first hose 66 extending upwardly through a top wall 72 of the backpack 12. The second end 70 is fluidly coupled to the inlet 62 of the first pump 60 thereby facilitating the first pump 60 to pump the pepper spray 42 in the first canister 44 outwardly through the first nozzle 48 when the first pump 60 is turned on.

A fire retardant unit 74 is positioned in the backpack 12 and the fire retardant unit 74 is in communication with the riot shield 18. Moreover, the fire retardant unit 74 sprays a fire retardant 76 outwardly from the riot shield 18 when the fire retardant unit 74 is turned on. In this way the police officer 20 can spray the fire retardant 76 to extinguish a fire. The fire retardant unit 74 comprises a second canister 78 that containing a fire retardant 76. The second canister 78 is positioned in the backpack 12 and the second canister 78 has an outlet 80. The fire retardant 76 may be a dry chemical fire retardant 76 that is approved for use on multiple types of fires.

The fire retardant unit 74 includes a second nozzle 82 that extends through the front side 22 and the back side 24 of the riot shield 18. The second nozzle 82 has a distal end 84 with respect to the front side 22 and the distal end 84 of the second nozzle 82 is open. Additionally, the second nozzle 82 is positioned between the window 38 and the bottom edge 28 of the riot shield 18. The fire retardant unit 74 includes a second conduit 86 that has a primary end 88 and a secondary end 90. The second conduit 86 has a bend 92 positioned between the primary end 88 and the secondary end 90. The primary end 88 of the second conduit 86 is fluidly coupled to a back side 24 of the second nozzle 82. Additionally, the primary end 88 of the second conduit 86 is pivotable on the back side 24 of the second nozzle 82. Thus, the second conduit 86 can be pivoted on the second nozzle 82 to be positioned in either the set of first clips 34 or the set of second clips 36. In this way the second conduit 86 can accommodate a left handed police officer 20 or a right handed police officer 20.

The fire retardant unit 74 includes a second pump 94 that is coupled to the back side 24 of the riot shield 18. The second pump 94 has an inlet 95 and an outlet 97, and the outlet 97 of the second pump 94 is fluidly coupled to the secondary end 90 of the second conduit 86. The fire retardant unit 74 includes a second hose 96 that has a first end 98 and a second end 100. The first end 98 of the second hose 96 is fluidly coupled to the outlet 80 on the second canister 78 having the second hose 96 extending upwardly through the top wall 72 of the backpack 12. The second end 100 of the second hose 96 is fluidly coupled to the inlet 95 of the second pump 94 thereby facilitating the second pump 94 to pump the fire retardant 76 in the second canister 78 outwardly through the second nozzle 82 when the second pump 94 is turned on.

A pair of handles 102 is each coupled to the riot shield 18 and each of the handles 102 can be gripped for carrying the riot shield 18. Each of the handles 102 has a central member 104 extending between a pair of end members 106, and each of the end members 106 is oriented perpendicular to the central member 104. A distal end 108 of each of the end members 106 is coupled to the back side 24 of the riot shield 18 having the central member 104 extending along an axis extending between the top edge 26 and the bottom edge 28 of the riot shield 18. The handles 102 are spaced apart from each other and are positioned on opposite sides of a center of the riot shield 18.

A pair of buttons 110 is each movably integrated into a respective one of the handles 102 such that each of the buttons 110 is accessible to the police officer 20. Each of the buttons 110 is in communication with a respective one of the pepper spray unit 40 or the fire retardant unit 74 for turning the respective pepper spray unit 40 or the fire retardant unit 74 on and off. Moreover, each of the buttons 110 is electrically coupled to a respective one of the first pump 60 or the second pump 94. Each of the buttons 110 turns the respective first pump 60 or second pump 94 on when the buttons 110 are depressed, and each of the buttons 110 is biased into an off position.

A power supply 112 is coupled to the riot shield 18 and the power supply 112 is electrically coupled to each of the buttons 110. The power supply 112 comprises at least one battery and the at least one battery may be a rechargeable battery of any conventional design. A gauge bar 114 is coupled between the pair of handles 102 and the gauge bar 114 includes a pair of gauges 116. Each of the gauges 116 is in fluid communication with a respective one of the first hose 66 or the second hose 96 thereby facilitating each of the gauges 116 to display a content level of a respective one of the first canister 44 or the second canister 78. Each of the gauges 116 may comprise an analog pressure gauge or the like.

In use, the police officer 20 wears the backpack 12 and grips each of the handles 102 to carry the riot shield 18. The respective button 110 is depressed to turn on the first pump 60 for spraying the pepper spray 42 outwardly from the first nozzle 48. In this way the police officer 20 can deploy the pepper spray 42 to subdue rioters while keeping both hands on the riot shield 18. Additionally, the respective button 110 is depressed to turn on the second pump 94 for spraying the fire retardant 76 outwardly from the second nozzle 82. In this way the police officer 20 can extinguish a fire while keeping both hands on the riot shield 18.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A riot shield assembly for dispensing pepper spray or a fire retardant, said assembly comprising:

a backpack being wearable on a police officer's back;

a riot shield being carried by the police officer wherein said riot shield is configured to protect the police officer from rioters;

a pepper spray unit being positioned in said backpack, said pepper spray unit being in communication with said riot shield, said pepper spray unit spraying a pepper spray outwardly from said riot shield when said pepper spray unit is turned on wherein said pepper spray unit is configured to deter rioters; and a fire retardant unit being positioned in said backpack, said fire retardant unit being in communication with said riot shield, fire retardant unit spraying a fire retardant outwardly from said riot shield when said fire retardant unit is turned on wherein said fire retardant unit is configured to extinguish a fire.

2. The assembly according to claim 1, wherein said riot shield has a front side and a back side, said riot shield being elongated between a top edge and a bottom edge of said riot shield, said riot shield having a set of first clips each being coupled to said back side, each of said first clips being positioned adjacent to a first lateral edge of said riot shield, said riot shield having a set of second clips each being coupled to said back side, each of said second clips being positioned adjacent to said second lateral edge of said riot shield, said riot shield having a window being integrated into said riot shield wherein said window is configured to facilitate the police officer to see through said riot shield, said window being positioned adjacent to said top edge.

3. The assembly according to claim 2, wherein said pepper spray unit comprises:

a first canister containing a pepper spray, said first canister being positioned in said backpack, said first canister having an outlet;

a first nozzle extending through said front side and said back side of said riot shield, said first nozzle having a distal end with respect to said front side, said distal end being open, said first nozzle being positioned between said window and said top edge of said riot shield; and a first conduit having a primary end and a secondary end, said first conduit having a bend positioned between said primary end and said secondary end, said primary end being fluidly coupled to a back side of said first nozzle, said primary end being pivotal on said back side, said first conduit being positionable in either said set of first clips or said set of second clips wherein said first conduit is configured to accommodate a left handed police officer or a right handed police officer.

4. The assembly according to claim 3, wherein said pepper spray unit includes a first pump being coupled to said back side of said riot shield, said first pump having an inlet and an outlet, said outlet of said first pump being fluidly coupled to said secondary end of said first conduit.

5. The assembly according to claim 4, wherein said pepper spray unit includes a first hose having a first end and a second end, said first end being fluidly coupled to said outlet on said first canister having said first hose extending upwardly through a top wall of said backpack, said second end being fluidly coupled to said inlet of said first pump thereby facilitating said first pump to pump said pepper spray in said first canister outwardly through said first nozzle when said first pump is turned on.

6. The assembly according to claim 2, wherein:

said pepper spray unit includes a first canister, a first nozzle and a first conduit;

said fire retardant unit comprises:

a second canister containing a fire retardant, said second canister being positioned in said backpack, said second canister having an outlet;

a second nozzle extending through said front side and said back side of said riot shield, said second nozzle having a distal end with respect to said front side, said distal end of said second nozzle being open, said second nozzle being positioned between said window and said bottom edge of said riot shield; and a second conduit having a primary end and a secondary end, said second conduit having a bend positioned between said primary end and said secondary end, said primary end of said second conduit being fluidly coupled to a back side of said second nozzle, said primary end of said second conduit being pivotal on said back side of said second nozzle, said second conduit being positionable in either said set of first clips or said set of second clips wherein said second conduit is configured to accommodate a left handed police officer or a right handed police officer.

7. The assembly according to claim 6, wherein:

said pepper spray unit includes a first pump; and said fire retardant unit includes a second pump being coupled to said back side of said riot shield, said second pump having an inlet and an outlet, said outlet of said second pump being fluidly coupled to said secondary end of said second conduit.

8. The assembly according to claim 7, wherein:

said pepper spray unit includes a first hose; and said fire retardant unit includes a second hose having a first end and a second end, said first end of said second hose being fluidly coupled to said outlet on said second canister having said second hose extending upwardly through a top wall of said backpack, said second end of said second hose being fluidly coupled to said inlet of said second pump thereby facilitating said second pump to pump said fire retardant in said second canister outwardly through said second nozzle when said second pump is turned on.

9. The assembly according to claim 2, further comprising a pair of handles, each of said handles being coupled to said riot shield wherein each of said handles is configured to be gripped for carrying said riot shield, each of said handles having a central member extending between a pair of end members, each of said end member being oriented perpendicular to said central member, a distal end of each of said end members being coupled to said back side of said riot shield having said central member extending along an axis extending between said top edge and said bottom edge of said riot shield, said handles being spaced apart from each other and being positioned on opposite sides of a center of said riot shield.

10. The assembly according to claim 9, further comprising:

a first pump;

a second pump; and a pair of buttons, each of said buttons being movably integrated into a respective one of said handles such that each of said buttons is accessible to the police officer, each of said buttons being in communication with a respective one of said pepper spray unit or said fire retardant unit for turning said respective pepper spray unit or said fire retardant unit on and off, each of said buttons being electrically coupled to a respective one of said first pump or said second pump, each of said buttons turning said respective first pump or said second pump on when said buttons are depressed, each of said buttons being biased into an off position.

11. A riot shield assembly for dispensing pepper spray or a fire retardant, said assembly comprising:

a backpack being wearable on a police officer's back, said backpack including a pair of shoulder straps;

a riot shield being carried by the police officer wherein said riot shield is configured to protect the police officer from rioters, said riot shield having a front side and a back side, said riot shield being elongated between a top edge and a bottom edge of said riot shield, said riot shield having a set of first clips each being coupled to said back side, each of said first clips being positioned adjacent to a first lateral edge of said riot shield, said riot shield having a set of second clips each being coupled to said back side, each of said second clips being positioned adjacent to said second lateral edge of said riot shield, said riot shield having a window being integrated into said riot shield wherein said window is configured to facilitate the police officer to see through said riot shield, said window being positioned adjacent to said top edge;

a pepper spray unit being positioned in said backpack, said pepper spray unit being in communication with said riot shield, said pepper spray unit spraying a pepper spray outwardly from said riot shield when said pepper spray unit is turned on wherein said pepper spray unit is configured to deter rioters, said pepper spray unit comprising:

a first canister containing a pepper spray, said first canister being positioned in said backpack, said first canister having an outlet;

a first nozzle extending through said front side and said back side of said riot shield, said first nozzle having a distal end with respect to said front side, said distal end being open, said first nozzle being positioned between said window and said top edge of said riot shield;

a first conduit having a primary end and a secondary end, said first conduit having a bend positioned between said primary end and said secondary end, said primary end being fluidly coupled to a back side of said first nozzle, said primary end being pivotal on said back side, said first conduit being positionable in either said set of first clips or said set of second clips wherein said first conduit is configured to accommodate a left handed police officer or a right handed police officer;

a first pump being coupled to said back side of said riot shield, said first pump having an inlet and an outlet, said outlet of said first pump being fluidly coupled to said secondary end of said first conduit; and a first hose having a first end and a second end, said first end being fluidly coupled to said outlet on said first canister having said first hose extending upwardly through a top wall of said backpack, said second end being fluidly coupled to said inlet of said first pump thereby facilitating said first pump to pump said pepper spray in said first canister outwardly through said first nozzle when said first pump is turned on;

a fire retardant unit being positioned in said backpack, said fire retardant unit being in communication with said riot shield, fire retardant unit spraying a fire retardant outwardly from said riot shield when said fire retardant unit is turned on wherein said fire retardant unit is configured to extinguish a fire, said fire retardant unit comprising:

a second canister containing a fire retardant, said second canister being positioned in said backpack, said second canister having an outlet;

a second nozzle extending through said front side and said back side of said riot shield, said second nozzle having a distal end with respect to said front side, said distal end of said second nozzle being open, said second nozzle being positioned between said window and said bottom edge of said riot shield;

a second conduit having a primary end and a secondary end, said second conduit having a bend positioned between said primary end and said secondary end, said primary end of said second conduit being fluidly coupled to a back side of said second nozzle, said primary end of said second conduit being pivotal on said back side of said second nozzle, said second conduit being positionable in either said set of first clips or said set of second clips wherein said second conduit is configured to accommodate a left handed police officer or a right handed police officer;

a second pump being coupled to said back side of said riot shield, said second pump having an inlet and an outlet, said outlet of said second pump being fluidly coupled to said secondary end of said second conduit; and a second hose having a first end and a second end, said first end of said second hose being fluidly coupled to said outlet on said second canister having said second hose extending upwardly through a top wall of said backpack, said second end of said second hose being fluidly coupled to said inlet of said second pump thereby facilitating said second pump to pump said fire retardant in said second canister outwardly through said second nozzle when said second pump is turned on;

a pair of handles, each of said handles being coupled to said riot shield wherein each of said handles is configured to be gripped for carrying said riot shield, each of said handles having a central member extending between a pair of end members, each of said end member being oriented perpendicular to said central member, a distal end of each of said end members being coupled to said back side of said riot shield having said central member extending along an axis extending between said top edge and said bottom edge of said riot shield, said handles being spaced apart from each other and being positioned on opposite sides of a center of said riot shield;

a pair of buttons, each of said buttons being movably integrated into a respective one of said handles such that each of said buttons is accessible to the police officer, each of said buttons being in communication with a respective one of said pepper spray unit or said fire retardant unit for turning said respective pepper spray unit or said fire retardant unit on and off, each of said buttons being electrically coupled to a respective one of said first pump or said second pump, each of said buttons turning said respective first pump or said second pump on when said buttons are depressed, each of said buttons being biased into an off position;

a power supply being coupled to said riot shield, said power supply being electrically coupled to each of said buttons, said power supply comprising at least one battery; and a gauge bar being coupled between said pair of handles, said gauge bar including a pair of gauges, each of said gauges being in fluid communication with a respective one of said first hose or said second hose thereby facilitating each of said gauges to display a content level of a respective one of said first canister or said second canister.

* * * * *